US005868548A

United States Patent [19]

Merwarth

[11] Patent Number: 5,868,548

[45] Date of Patent: Feb. 9, 1999

[54] STACKING DEVICE FOR PRINTER PRODUCTS AND THE LIKE

[75] Inventor: Richard J. Merwarth, Bay Village, Ohio

[73] Assignee: Total Mailroom Support, Inc., Middleburg Heights, Ohio

[21] Appl. No.: 806,845

[22] Filed: Feb. 26, 1997

Related U.S. Application Data

[60] Provisional application No. 60/012,310 Feb. 26, 1996.

[51] Int. Cl.[6] ..... B65B 13/00

[52] U.S. Cl. ..... 414/790.3; 414/390.4; 414/900

[58] Field of Search ..... 414/788.3, 790, 414/790.3, 790.4, 790.5, 790.6, 791.1, 900, 789.9

[56] References Cited

U.S. PATENT DOCUMENTS

| | | | |
|---|---|---|---|
| 4,068,567 | 1/1978 | Allison et al. | 414/790.3 |
| 4,103,785 | 8/1978 | Wiseman | 198/374 |
| 4,162,733 | 7/1979 | Wiseman | 271/218 |
| 4,397,229 | 8/1983 | Merworth et al. | 414/790.3 |
| 4,421,221 | 12/1983 | Pessina et al. | 414/788.3 |
| 4,457,656 | 7/1984 | Kosina et al. | 414/790.4 |
| 4,749,077 | 6/1988 | Sjorgren | 198/412 |
| 4,812,099 | 3/1989 | Sjogren et al. | 414/788.2 |
| 5,054,993 | 10/1991 | Watts et al. | 414/790.5 |
| 5,141,219 | 8/1992 | Watts et al. | 271/203 |
| 5,226,780 | 7/1993 | Sjogren et al. | 414/790.4 |
| 5,338,149 | 8/1994 | Wiseman | 414/792.7 |
| 5,433,582 | 7/1995 | Medina | 414/788.3 |

*Primary Examiner*—Karen M. Young
*Assistant Examiner*—Gregory A. Morse
*Attorney, Agent, or Firm*—Fay, Sharpe, Beall, Fagan, Minnich & McKee

[57] ABSTRACT

The stacking device for printed products includes a rotatable turntable platform for stacking articles, an ejection assembly for ejecting stacks of articles from the platform, and a positioning device for positioning the turntable for two direction ejection. The positioning device allows the turntable to be arranged for ejecting stacks either parallel or normal to a direction in which articles are fed into the stacking device. This versatility of output allows the stacking device to be incorporated into a plant arrangement more easily and reduces floor space and expense of the entire system. The stacking device also includes an article receiving portion which receives and accommodates articles of differing heights without changing an infeed location of the stacking device. According to one embodiment, the stacking device includes an ejection assembly including two chains received in tracks in the turntable and two posts mounted on the chains which eject the stacks without imparting a rotational moment to the stacks.

25 Claims, 9 Drawing Sheets

STACKING DEVICE FOR PRINTER PRODUCTS AND THE LIKE

This application claims benefit of provisional application No. 60/012,310, filed on Feb. 26, 1996.

BACKGROUND OF THE INVENTION

The present invention relates to the field of article stacking devices, and more particularly to stacking devices for assembling a stream of printed products into stacks and ejecting the stacks of printed products.

Newspapers and other printed matter which is ejected from a printing press or inserting machine is generally folded and delivered in a continuous stream with the papers in an overlapped relationship. The papers from the printing press are received and stacked by a stacking apparatus which must operate at very high speeds. The stacking apparatus generally forms the papers into stacks and ejects the stacks of papers in two directions from the stacker at a rate which exceeds one stack ejected per second.

The known stacking apparatuses generally operate by moving a fork into the continuous stream of papers to collect a desired number of papers which form a batch. The forks are generally spring mounted to a chain drive which rotates to continually receive and deliver batches of papers. After a predetermined count of papers are received on a fork, a next fork intercepts the paper stream and begins collecting papers for a next batch. The forks move downward as the papers are collected and drop the completed batches onto a turntable which collects the papers in a stack.

Since newspapers and other printed materials generally have a thickness which is greater along the folded side or sides of the papers than on the unfolded sides of the papers, two or more batches are generally stacked on the turntable with the folded edges of the successive batches rotated 180° with respect to one another to achieve a stack with an even height. In order to form an even stack with rotated batches, the stacking platform or turntable is driven by a heavy duty motor which rotates the turntable 180° between dropping of successive batches by the forks.

Once a predetermined stack size is reached, the stack is ejected from the stacking machine by pushing the stack off of the turntable with a pusher bar. The pusher bar of known stackers extends vertically through the turntable by passing through a clearance gap provided between two halves of the turntable platform. The pusher bar is driven by a chain drive to push the stack from the turntable onto one of two conveyors which are arranged to receive the stacks in two directions which are 180° from each other.

The known stacking apparatuses are generally designed to operate with newspapers or other flat articles which vary in size, shape, weight, and conformity, and are not dimensionally stable. Therefore, the turntables of stackers generally include adjustable side walls or guides on all four sides of the stack which align and stabilize the stack. The end guides provided on the opposite ends of the stack are mounted on springs so that these end guides will open to allow the stacks to be ejected.

One drawback of known stacking apparatuses is the fact that the stacks are ejected only in the two directions which are normal to the direction in which the stream of newspapers enters the stacker. Thus, for many printing setups, the stream of incoming papers must be turned 90° before entering the stacker. Alternatively, the two streams of stacks exiting the stacker may have to be turned 90°. This need to rotate either the stream of papers or the two streams of stacks for some plant setups adds to the complexity, expense, and space taken up by the entire line.

SUMMARY OF THE INVENTION

According to one aspect of the invention, a stacking apparatus includes an infeed assembly receiving a stream of papers traveling in an infeed direction, a plurality of movable forks receiving the stream of papers in a plurality of batches, a turntable assembly for receiving said batches to form stacks, the turntable assembly including a rotatable turntable and a discharge element for ejecting the stacks in two opposite stack discharge directions, and a motor for rotating the turntable assembly 180° between successive batches. Positioning means position the turntable assembly in a first position in which the two opposite stack discharge directions are at a first angle with respect to the infeed direction and in a second position in which the two opposite stack discharge directions are at a second angle with respect to the infeed direction.

According to a further aspect of the invention, a turntable assembly for a stacking includes a rotatable turntable platform having two substantially semicircular tracks formed at a top surface of the platform, the tracks extending in parallel paths along a center portion of the turntable platform, an ejection assembly for ejecting stacks from the turntable platform including two chains received in the two tracks and at least one post extending from each of the chains, and a motor driving the two chains to move the posts together along the parallel paths to eject the stacks without imparting a rotational moment to the stacks.

According to an additional feature of the present invention, a turntable assembly for a stacking device includes a rotatable turntable platform for stacking articles, an ejection assembly for ejecting stacks of articles from the turntable platform, two side guide members extending vertically from the turntable platform and adjustable to vary a first dimension of the stack between the two side guide members, two end guide members mounted on each of the side guide members for abutting ends of the stacks, the end guide members being adjustable to vary a second dimension of the stack, and a pneumatic device holding the end guide members in a closed position.

In accordance with another aspect of the invention, a stacking device for stacking articles includes an infeed assembly including a pivotable upper conveyor which pivots to accommodate articles of different thicknesses and a lower conveyor which is fixed during infeeding of articles, a stacking portion for stacking the articles received from the infeed assembly on a rotatable turntable, and a discharging device for ejecting stacked articles from the turntable.

According to a further aspect of the present invention, a method of stacking articles includes selecting a discharge orientation from two discharge orientations which are rotated 90° with respect to each other, adjusting a position of a turntable in a stacking device to the selected discharge orientation, feeding a stream of articles into the stacking device in an infeed direction, stacking the articles in stacks on the turntable, and discharging the stacks of articles in first and second opposite directions from the turntable, the first and second opposite directions corresponding to the selected discharge orientation.

One advantage of the present invention over known stacking apparatuses is that stacks can be ejected in the two directions parallel to the incoming stream of papers or in the two directions normal to the incoming stream of papers. This versatility of stacker output allows the stacker to be more easily incorporated into an assembly line without the need to rotate either the incoming stream of papers or the outgoing streams of stacks.

Another advantage of the present invention is the ability to provide a constant interrupt position and a constant stack height regardless of the height of the individual papers entering the stacking apparatus.

A further advantage of the present invention resides in the ejection of article stacks without imparting a rotational moment to the article stacks which are discharged.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof, and wherein.

DETAILED DESCRIPTION OF THE PREFERRED EMBODIMENT

Figure 1:
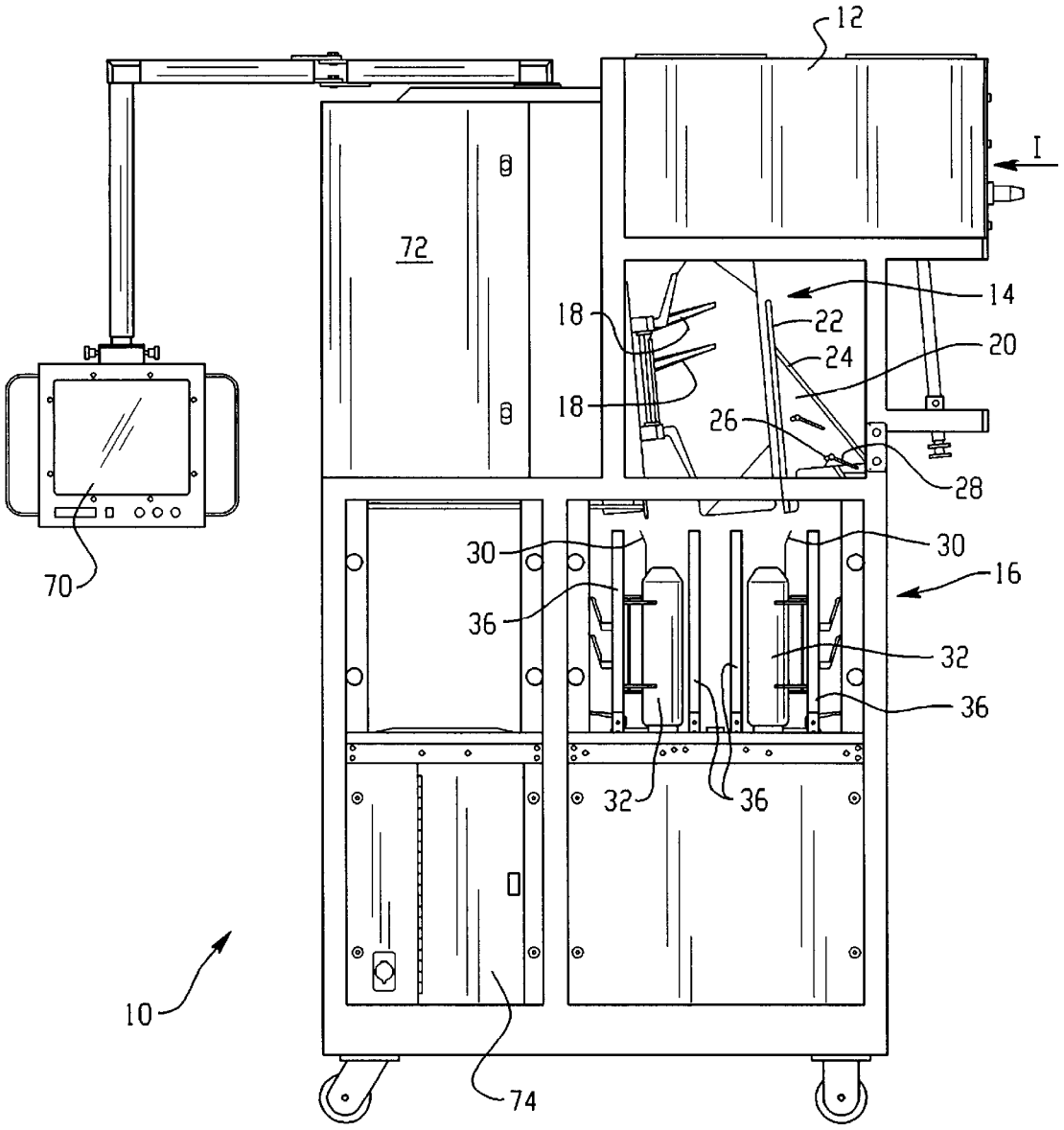
FIG. 1 is a left side view of a stacking device according to the invention.

Referring now to the drawings wherein the showings are for the purposes of illustrating the preferred embodiment of the invention only and not for purposes of limiting same, the FIGURES show a stacking apparatus 10 including an infeed assembly 12 for receiving an input stream of folded overlapping papers, a stacking section 14 for forming the papers into batches or bundles, and a turntable assembly 16 for receiving the batches in a stack and ejecting these stacks in two opposite directions. The stacking apparatus is described herein for use in stacking newspapers or papers, however, it should be understood that the stacking apparatus is intended to be used for stacking any substantially flat articles including both printed and unprinted materials.

Figure 2:
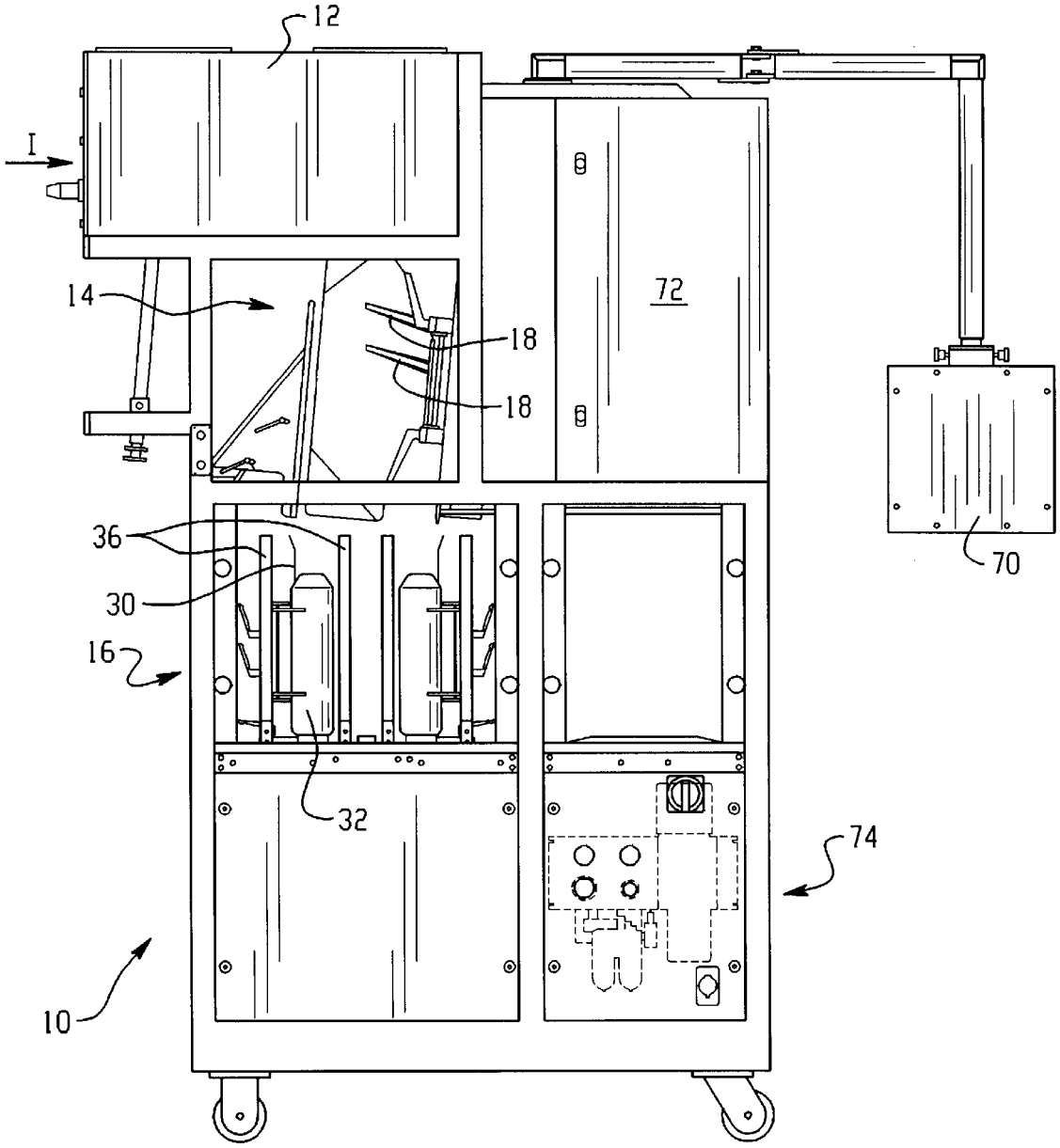
FIG. 2 is a right side view of the stacking device of FIG. 1.

With respect to FIGS. 1 and 2, papers coming from a printing press are fed into the stacking apparatus 10 in an infeed direction illustrated by the arrow I between an upper conveyor and a lower conveyor of the infeed assembly 12. The papers are fed in with their folded side passing into the stacking apparatus first and with the folded edges of each of the papers overlapping a previous paper. The papers are delivered by conveyors in the infeed assembly 12 to the stacking section 14.

The stacking section 14 includes a plurality of forks 18 which are formed of a pair of claws mounted at fixed distances apart along a pair of closed loop drive chains. These forks 18 each receive and support a bundle or batch of papers which drop onto the forks from the infeed assembly 12. Various mechanical and/or optical sensors may be used in connection with the stacking section 14 to count a number of papers in each batch and to control the movement of the forks 18 to obtain a desired number of papers in each batch. The forks 18 are spring loaded to intercept the continuous stream of papers. The stacking section 14 also includes a guide device 20 which guides the trailing edges of the papers as the papers pass onto the forks 18. The guide device 20 includes a substantially planar guiding surface 22 and a support member 24. The support member 24 includes slots 26 receiving locking members 28 which allow the position of the guide device 20 to be adjusted to accommodate papers of different sizes.

As the forks 18 move downward and reach a bottom of the closed loop drive chains, the forks rotate causing the batch of papers to be released or dropped into the turntable assembly 16. The turntable assembly 16 includes side guide members 30 for supporting the stack of papers on two opposite sides, and end guide members 32 for supporting the stack of papers on the two opposite ends. The guide members 30, 32 taper outward at their top edges to receive the papers. The end guide members 32 pivot open and closed to allow the stacks of papers to be ejected from the turntable assembly when the end guide members are in an open position. The configurations and operation of the guide members 30, 32 will be described in further detail below with respect to FIGS. 7 and 8.

The turntable assembly 16 also includes an eject assembly for ejecting the stacks of papers from the turntable in two opposite directions onto conveyors which transport the stacks away from the stacking apparatus 10. The eject assembly includes vertical posts 36 which extend from the turntable and engage the entire height of a stack of papers to push the stack off of the turntable. The eject assembly will be discussed in more detail below with respect to FIGS. 5 and 6.

As a batch of papers is delivered to the turntable assembly 16 by the stacking section 14, often the stack will be higher on one side than the other due to the thickness of the fold or spine of the paper. In order to achieve a stable stack having an even height, the turntable assembly 16 is rotated 180° between delivery of successive batches of papers. It is also possible to rotate the turntable assembly 90° between delivery of batches when a stack of square papers is being formed. However, in general, stacked papers are not square, thus, a 180° rotation is used.

The stacking apparatus 10 of FIGS. 1 and 2 also includes an operator station 70 for operator control of the stacking apparatus, an electrical and power supply panel 72 for controlling the coordination of the various functions of the stacker, and a pneumatic control assembly 74 for controlling the various pneumatic devices of the stacker. These control elements may be any of those control elements which are known to those in the art.

Figure 3:
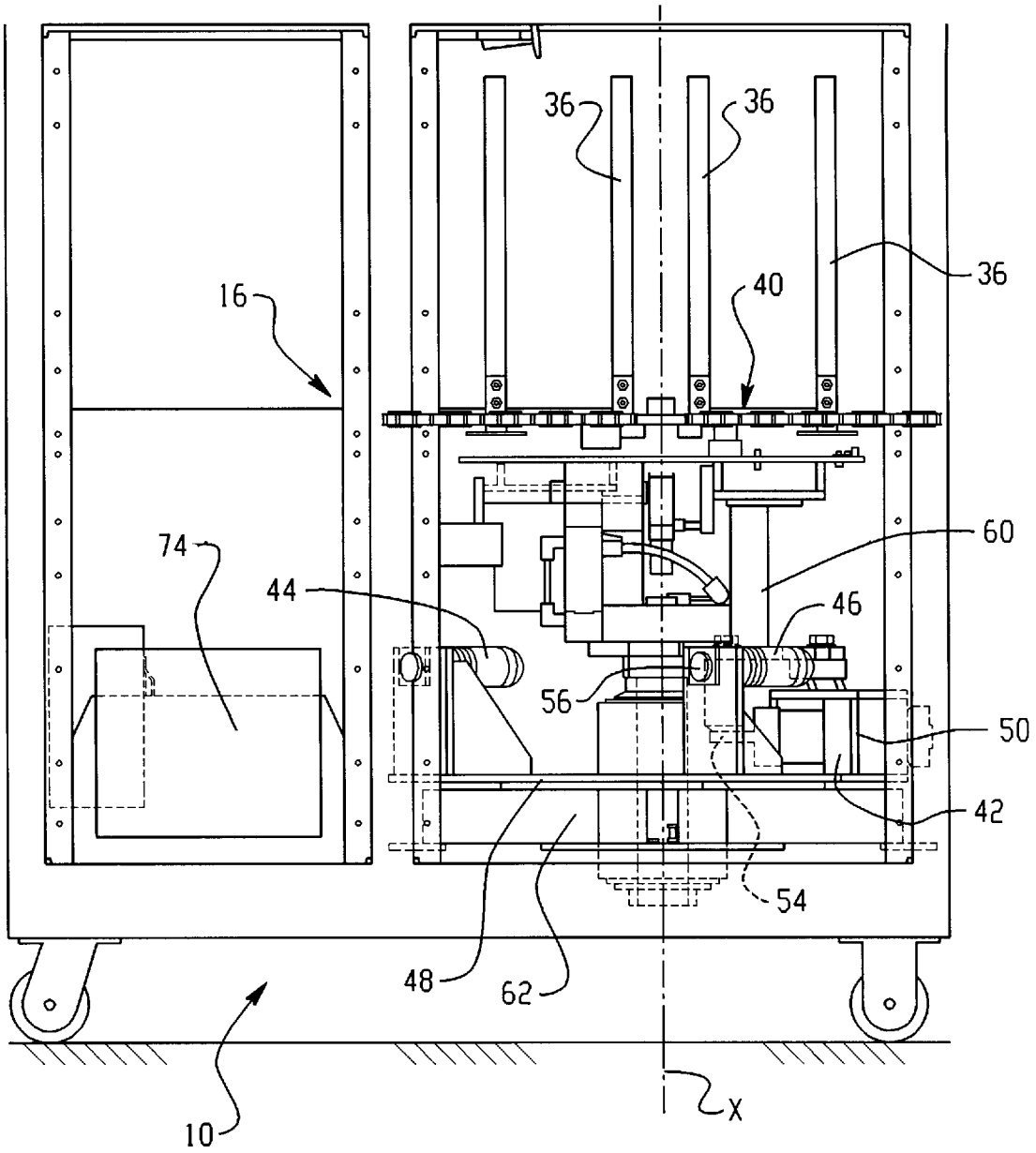
FIG. 3 is an enlarged left side view of the lower half of the stacking device in which the lower panel has been removed to expose the turntable motor assembly.

FIG. 3 is a side view of a lower portion of the stacking apparatus 10 with the lower side panel removed to expose a lower portion of the turntable assembly 16 and a drive assembly for rotating the turntable assembly back and forth 180°. The drive assembly includes an air operated cylinder 42 or motor for rotating the turntable and two shocks 44, 46 for stopping the turntable rotation. A motor for rotating the turntable is preferably the pneumatic cylinder 42, however, other types of motors may also be used. The cylinder 42 is pivotally mounted on a base plate 48 by a cylinder pivot frame assembly 50. A piston rod 52 of the cylinder 42 is pivotally attached to a portion of the rotatable turntable frame 60 by a cylinder stud 54 at a point which is displaced from an axis of rotation X of rotation of the turntable 40. The pneumatic cylinder 42 or motor operates to rotate the turntable 40 back and forth through 180° of rotation.

The shocks 44 and 46 halt the motion of the turntable 40 more quickly than the cylinder 42 alone and allow the cylinder to rotate the turntable at a speed which is higher than the speeds currently used in stacking devices without shocks. The shocks 44, 46 stop the rotation of the turntable 40 by engaging one of two pads 56 mounted on the turntable frame 60. The shocks 44, 46 are preferably heavy duty shocks.

Figure 4:
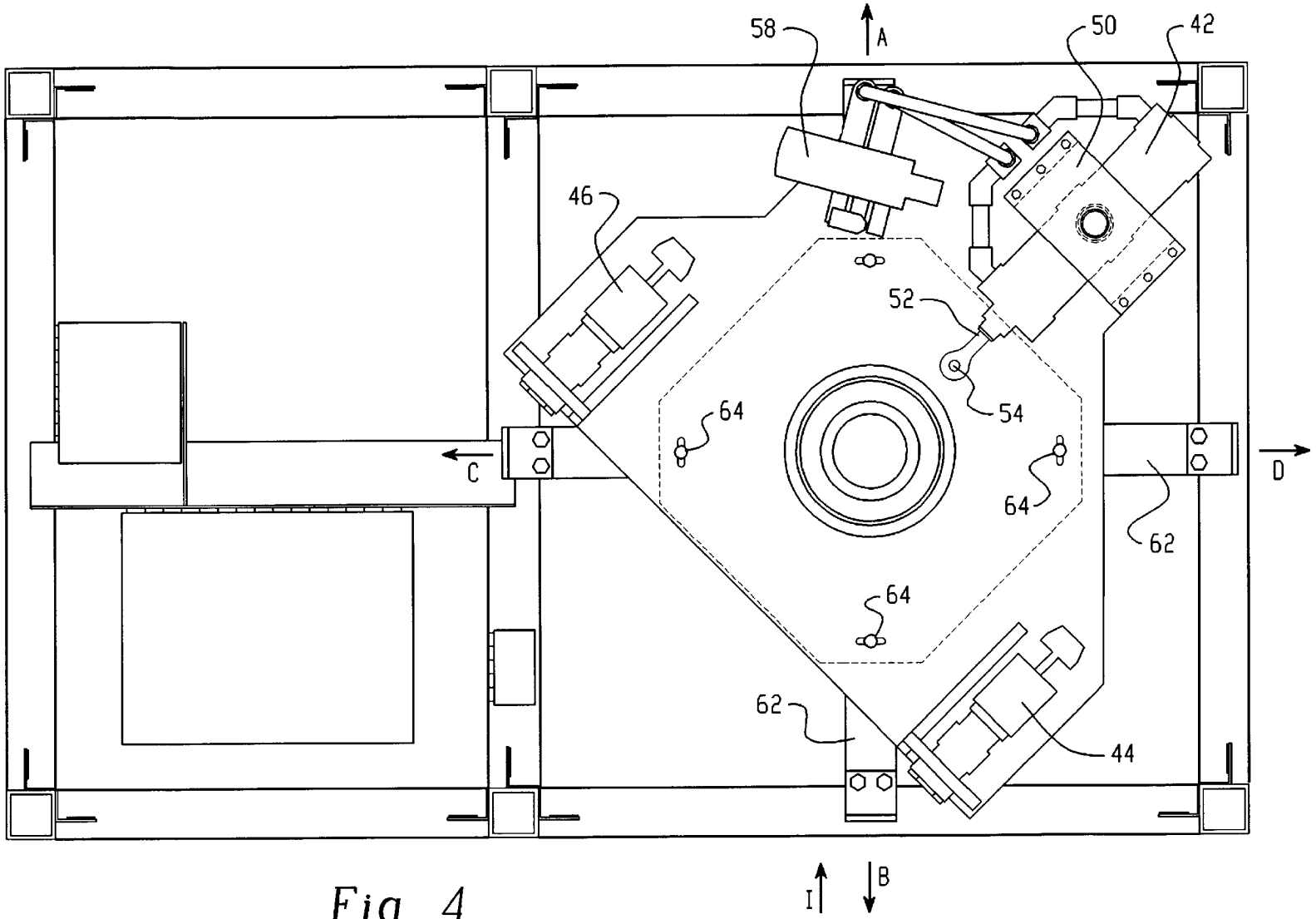
FIG. 4 is a top view of the motor drive assembly for driving the turntable without the rotatable turntable or turntable frame assembly.

The pneumatic cylinder 42 and pivot frame assembly 50 supporting the cylinder, as well as the shocks 44, 46 are best illustrated in the top view of FIG. 4 in which the turntable assembly has been omitted for clarity. The turntable 40, the cylinder 42, and the shocks 44, 46 are mounted on the base plate 48 along with a pneumatic control valve assembly 58 for controlling the pneumatic cylinder. This base plate 48 is rotatable on the base frame 62 of the stacking apparatus to allow the turntable assembly to be rotated to two different positions or orientations to eject paper stacks in different directions. The base plate 48 is rotated by removing the four bolts 64 which secure the base plate to the base frame 62 and rotating the base plate 48 about a central bearing to a new position where the bolts are then resecured.

By allowing rotation of the entire turntable 40, motor or cylinder 42, and shocks 44, 46, the stacking device can advantageously eject stacks either in the two opposite directions A and B which are parallel to an infeed direction I of the stacker or may eject stacks in the two opposite directions C and D which are normal to the infeed direction I.

Figure 5:
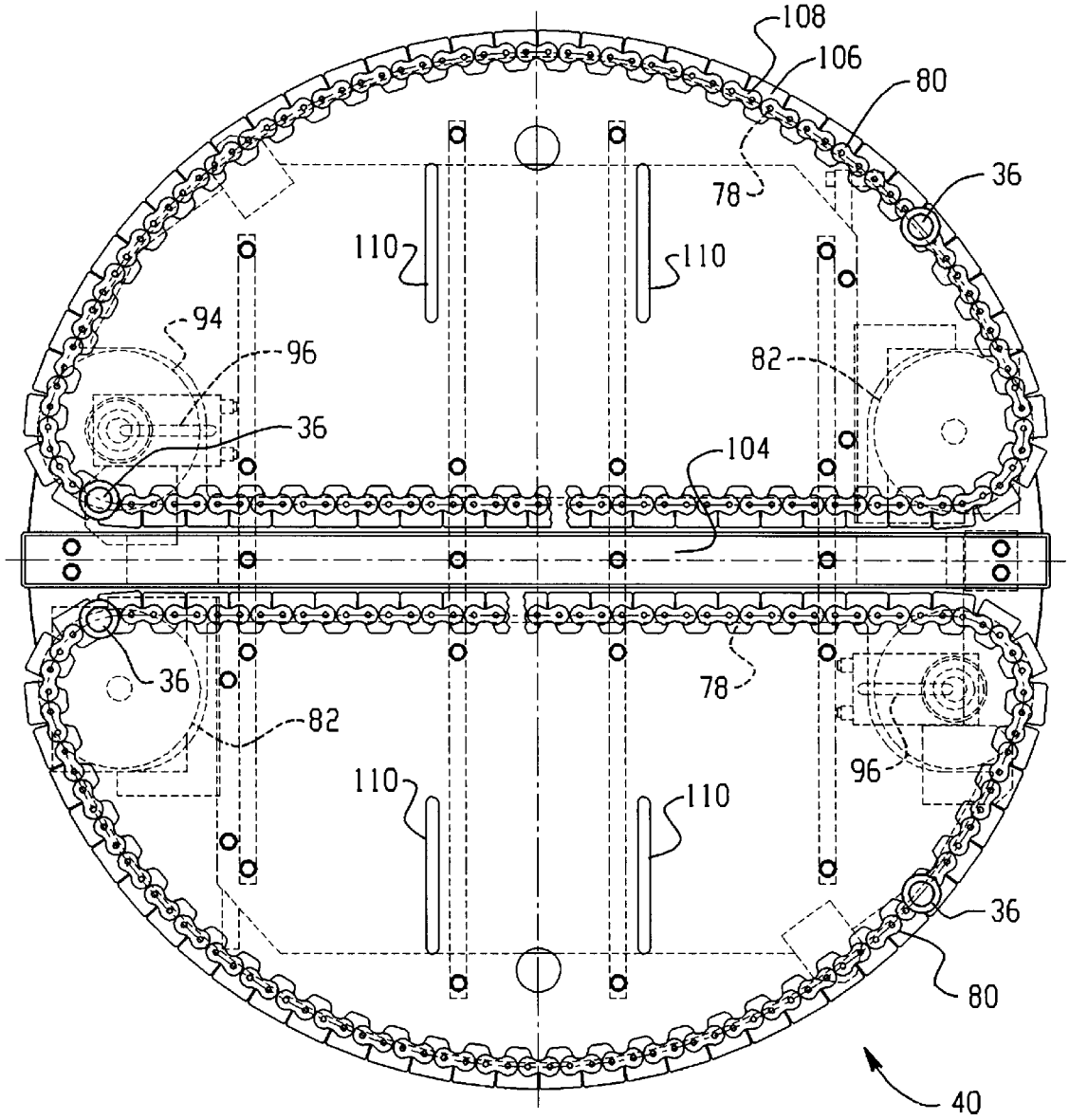
FIG. 5 is a top view of the turntable and eject assemblies.
Figure 6:
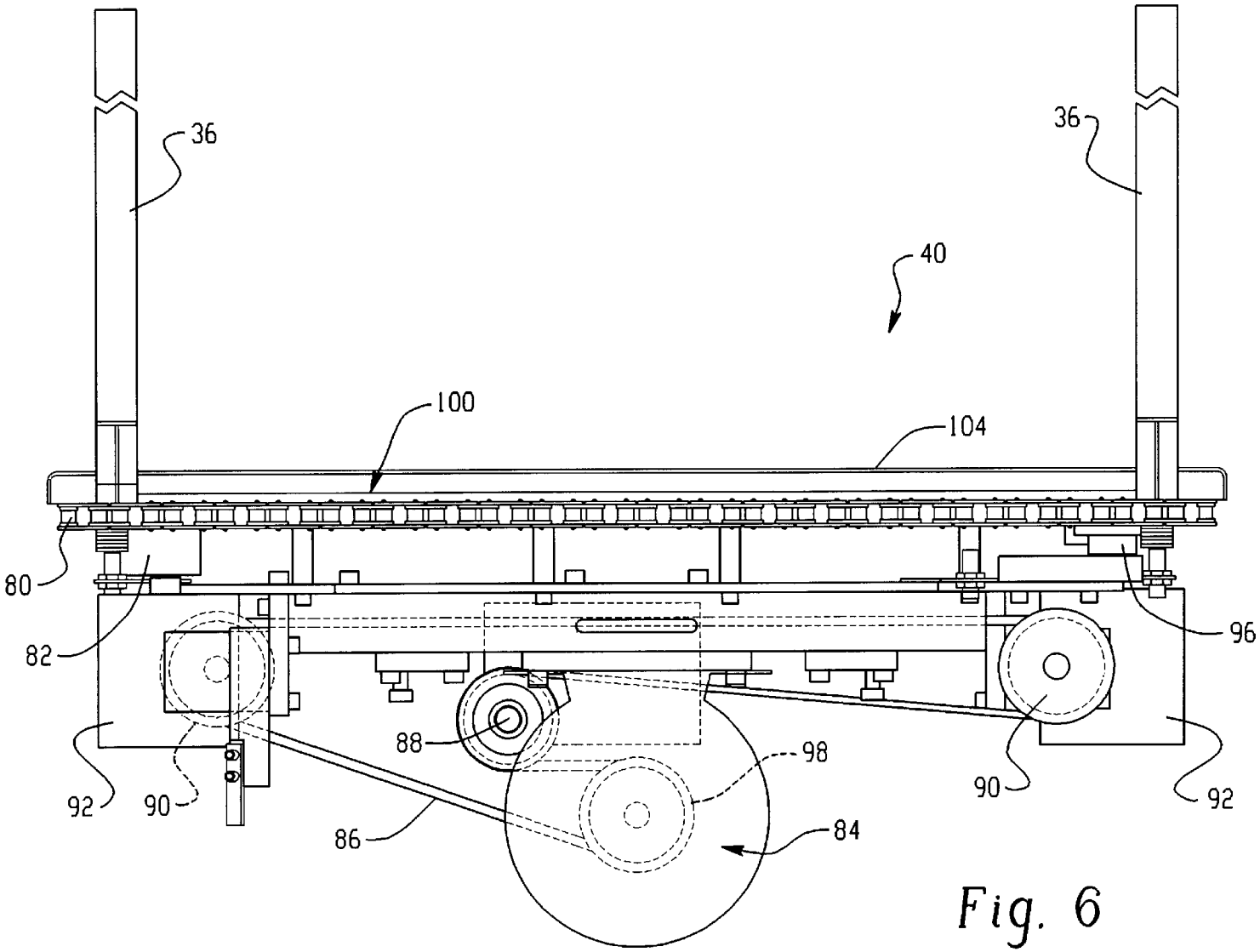
FIG. 6 is a side view of the turntable and eject assemblies of FIG. 5.

The turntable assembly 16 including the eject assembly is illustrated in further detail in FIGS. 5 and 6. For purposes of clarity, the guide members 30, 32 which support the sides of the stack have been omitted from FIGS. 5 and 6. The eject or discharge assembly includes two chains 80 which travel along paths having a semicircular portion and a straight portion at an upper surface 100 of the turntable 40 as shown in the top view of FIG. 5.

The chains 80 include a plurality of inner links 106 interconnected by outer links 108. The inner links 106 are received on protruding portions or ridges 76 of the turntable 40 and ridges 78 of a plate surrounding the turntable. The ridges 76, which form tracks 78 for the chains. The chains 80 each have an upper surface which is substantially even with the upper surface 100 of the turntable 40 and have a lower surface which extends into the surface of the turntable.

As seen in FIG. 5, a center rail 104 is formed between the straight segments of the two chains 80 to space the chains apart. A top surface of the center rail 104 is slightly elevated above the turntable upper surface 100.

The chains 80 are each driven by at least one drive gear 82 and are supported by an addition idler gear 94. The drive and idler gears 82, 94 are preferably located at the intersections of the straight and semicircular portions of the chain travel paths. The two idler gears 94 are preferably mounted in the turntable by a slotted configuration 96 which allows the idler gears to be adjusted to adequately tension the chains 80.

Figure 6A:
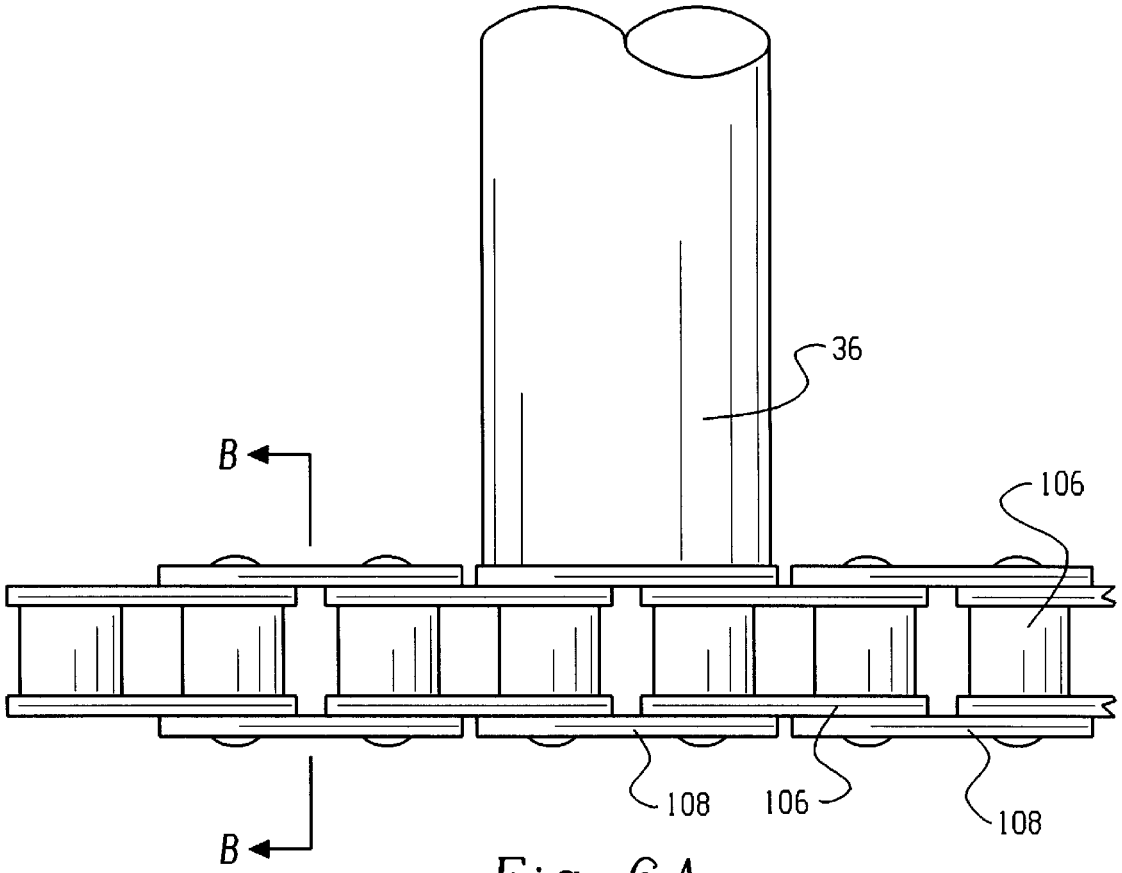
FIG. 6A is an enlarged side view of the chain and post of FIG. 6.
Figure 6B:
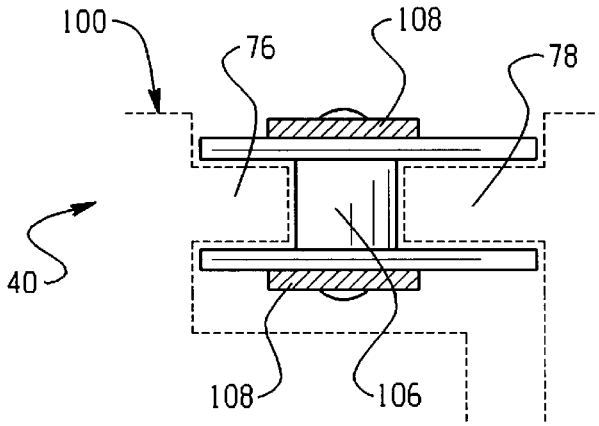
FIG. 6B is a cross-sectional view of the chain taken along line B—B in FIG. 6A and illustrating the chain receiving track in hidden lines.

The four posts 36 for ejecting the stacks from the turntable 40 are connected to the chains 80, as shown in FIG. 6A, by securing a lower surface of the post to an upper surface of one of the outer links 108. The posts 36 extend vertically from the surface of the turntable 40 and are supported entirely by the chain 80. The posts 36 have a height which is approximately equal to a height of the stack to be ejected so that when the posts push a stack off of the turntable, the entire height of the stack is engaged by the post and an even stack is maintained.

The eject assembly employs two chains 80 having two posts 36 used simultaneously to eject a stack of papers. The ejection of the stacks with two posts 36 provides a distinct advantage over known ejection assemblies using a single post because the single post will cause the stack of papers to rotate due to the lateral motion of the post at the end of the turntable as the chain turns around the gear. With two posts 36 mounted on two opposing chains 80, as in the present invention, any rotational moment applied to the stack by one post will be opposed by an opposite rotational moment applied to the stack by the other post.

The drive mechanism for operation of the eject assembly is best shown in FIG. 6 which is a side view of the turntable assembly 16. The eject assembly includes a motor 84 having a drive roller 98 on an output shaft thereof which drives a belt 86. The belt 86 passes around an idler roller 88 and two gearbox rollers 90 of the gearboxes 92. The gearboxes 92 transmit power from the gearbox rollers 90 which are driven by the motor 84 to the two gears 82 which drive the two chains 80. The drive roller 98 of the motor 84, the idler roller 88, and the two gearbox rollers 90 are positioned along a central plane of the turntable which passes between the straight segments of the two chains 80. The belt 86 is preferably a toothed belt having transversely extending teeth or ridges which engage corresponding teeth or ridges on each of the rollers 88, 90, and 98.

Figure 8:
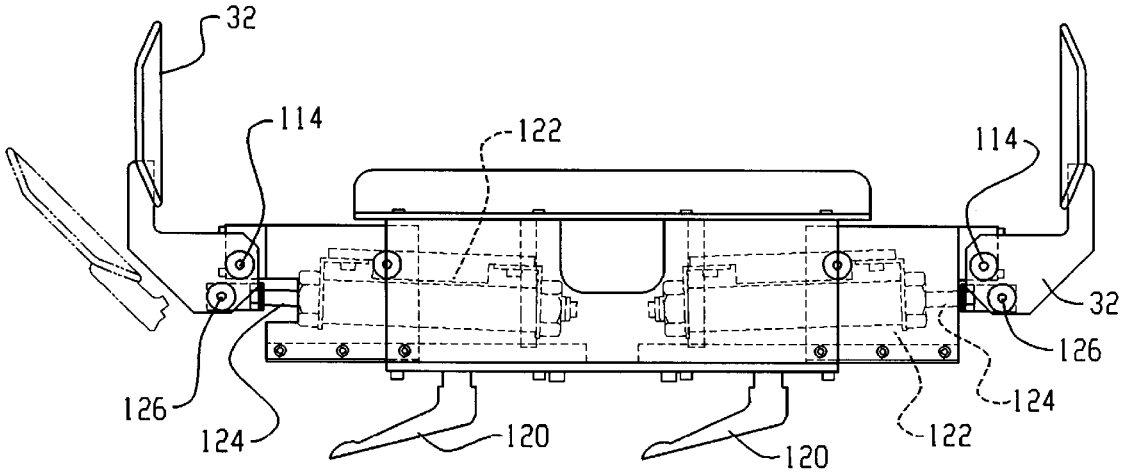
FIG. 8 is a top view of the turntable guide members of FIG. 7.
Figure 7:
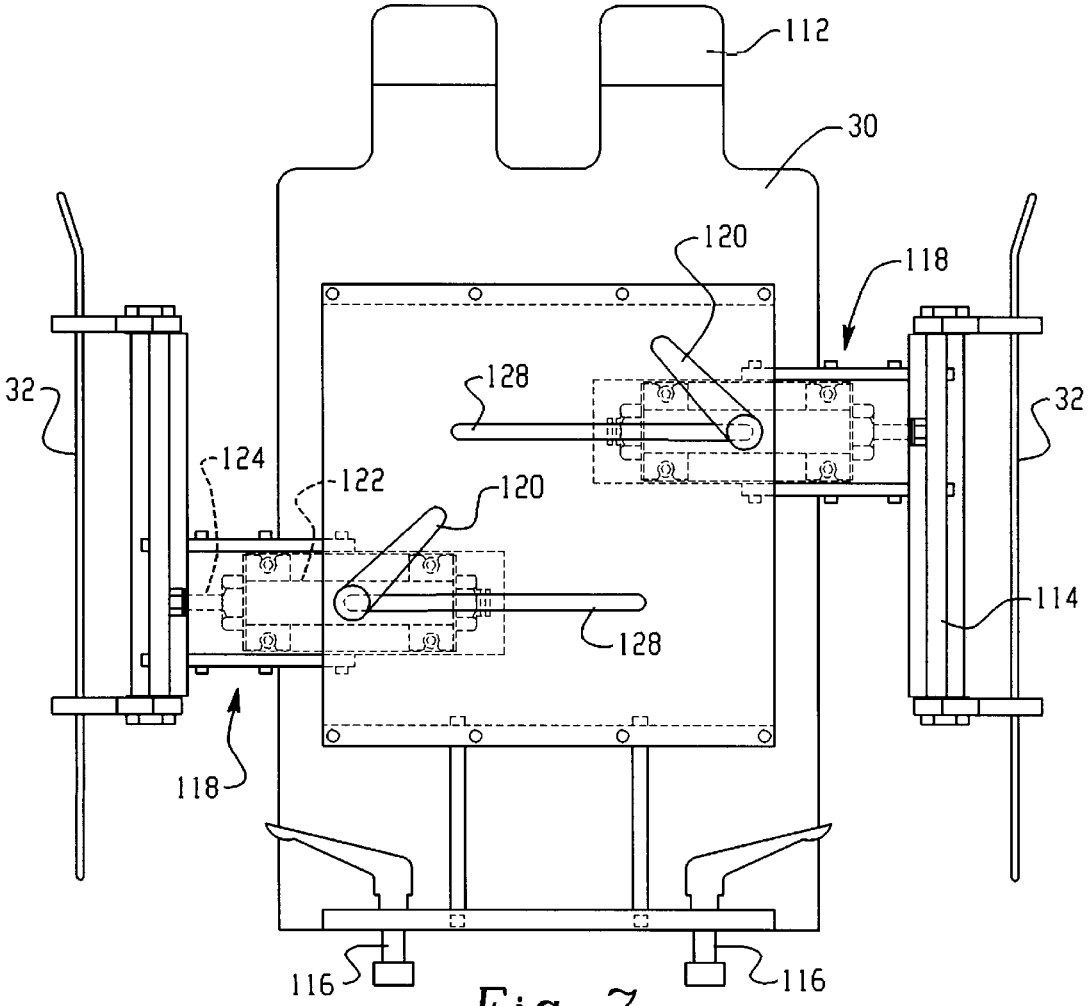
FIG. 7 is a side view of the turntable guide members.

Mounted on the turntable 40 is the guide and gate assembly illustrated in FIGS. 7 and 8 which provides lateral support to the stack of papers on the turntable. The side guide members 30 are two vertically extending substantially planar members with upper edges 112 which extend outward away from the center of the turntable to receive papers from the stacking section 14. The end guide members 32 are each pivotally mounted on a support assembly 118 by the pivots 114. Two of the support assemblies 118 are mounted on each of the side guide members 30 such that two end guide members 32 pivotally support the stack at each end of the stack. The guide and gate assembly of FIG. 7 is adjustably mounted on the turntable 40 shown in FIG. 5 by locking members 116 which are received in slots 110 of the turntable. The slots 110 allow the two side guide members 30 to be adjusted to different spacings to accommodate paper having varying widths. In addition, each of the end guide members 32 is adjustably mounted to one of the side guide members 30 by engagement of a locking member 120 on the support assembly 118 in a slot 128 in the side guide members.

The pivoting of the end guide members or gates 32 allows a stack of papers to be ejected when the end guide members are pivoted to the open position illustrated in hidden lines on the left side of FIG. 8. During the stacking operation, the end guide members 32 are closed and held in the closed position by a pneumatic cylinder 122 mounted on the support assembly 118. The pneumatic cylinder 122 has a piston rod 124 pivotally connected to the end guide member 32 at a pivotal connection 126. When a stack of papers is ready to be ejected from the turntable, the air supply to the pneumatic cylinder 122 is stopped allowing the end guide members 32 to pivot to the open position due to the force of the stack which is being pushed off the turntable by the ejection assembly.

The pneumatic control of the gates 32 in the stacking device of the present invention allows the turntable to be loaded by releasing the papers from the forks 18 of the stacking section 14 in any orientation without the gates opening due to the force of the delivery of the papers to the turntable. With a prior art turntable having conventional spring loaded gates rather than pneumatically controlled gates, the spring loaded gates will be forced open by the papers if the papers are dumped against the spring loaded gates rather than against the fixed side guide members. However, in the present invention, the papers can be dumped against either the side guide members 30 or the pivotable end guide members 32 depending on the orientation of the turntable without the end guide members pivoting open.

Figure 9:
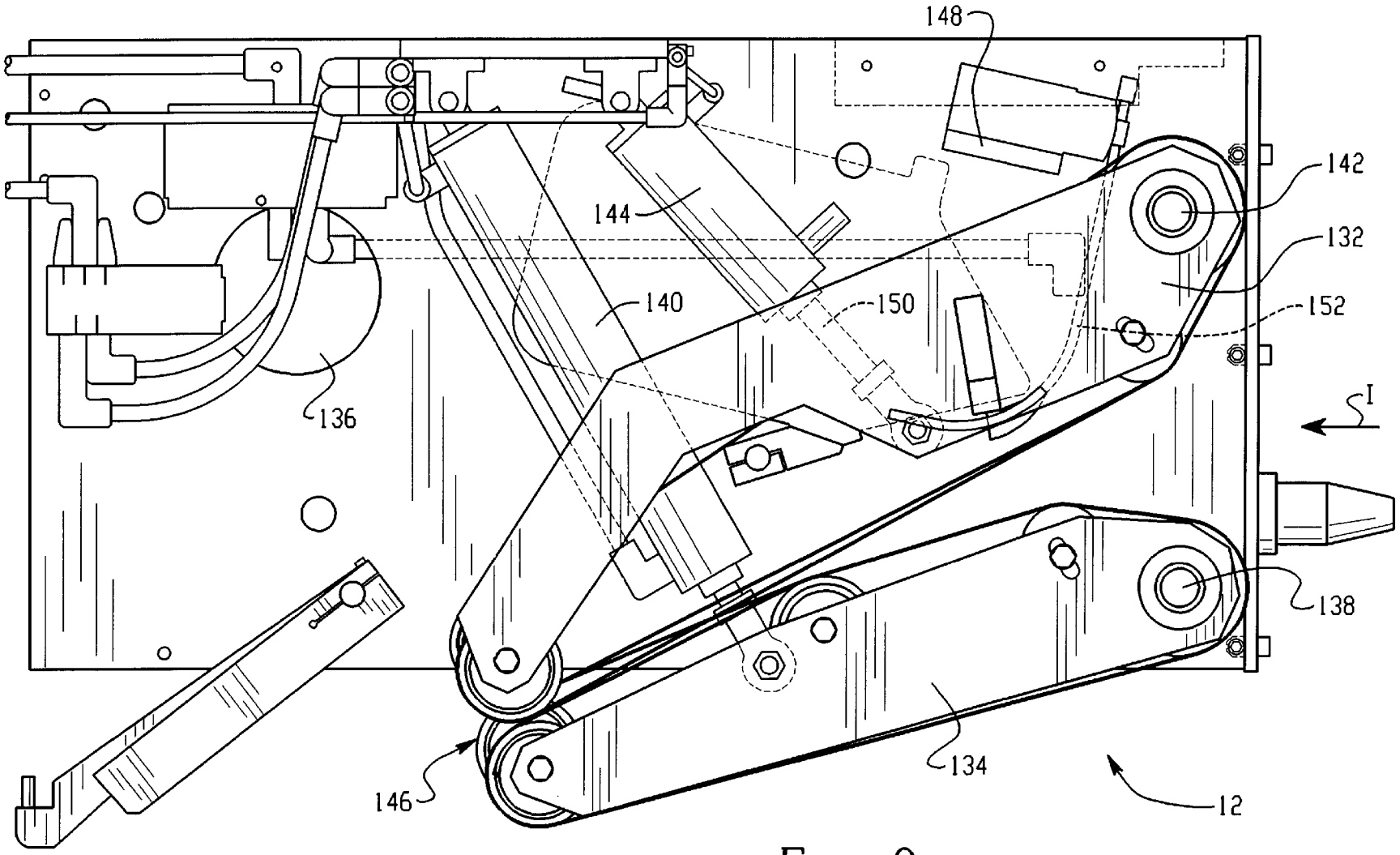
FIG. 9 is a side view of the infeed assembly.

FIG. 9 is a side view of the infeed assembly 12 for receiving papers which enter the stacking apparatus 10 in a stream. The papers are fed to the stacker in an infeed direction I from a printing apparatus and pass into the stacking apparatus 10 between an upper conveyor or belt assembly 132 and a lower conveyor or belt assembly 134. The upper and lower belt assemblies 132, 134 each include preferably three or more belts mounted on a plurality of rollers. The belts are driven by a motor 136 which drives the belts via a power transmission system (not shown). The lower belt assembly 132 is pivotally mounted by a pivot 138 at an upper end thereof and is supported by a first pneumatic cylinder 140. The first pneumatic cylinder 140 allows the lower belt assembly 134 to pivot downward to dump the papers in response to a jam which occurs in the stacking apparatus. The lower belt assembly 134 is maintained stationary during stacking, except in the instance of a dumping operation.

The upper belt assembly 132 is mounted on a pivot 142 at its upper end and on a piston 150 of a second pneumatic cylinder 144. A lower end of the upper belt assembly 132 is permitted to float or move up and down in response to the thickness of the papers passing between the upper and lower belts. The amount of float or give of the upper belt assembly 132 is determined by the amount of stroke in the cylinder 144. A limit switch 148 includes a depending wire 152 which deflects to detect a jam entering the infeed assembly 12. When a jam is detected, the pneumatic cylinder 140 strokes to dump the jammed papers.

The configuration of the infeed assembly 12 in which the lower belt assembly 134 is fixed while the upper belt assembly 132 is allowed to pivot or float is particularly advantageous because the inlet position 146 at which the papers enter the stacking section 14 of the stacking apparatus is maintained constant. Thus, the height for each batch received by the forks 18 and the interrupt point at which a next fork interrupts the batch is maintained constant regardless of the thickness of the paper.

The invention has been described as operating to eject stacks of papers in two directions which are either parallel to or normal to an infeed direction. It should be understood that the invention can be used to eject stacks in four directions by rotation of the turntable for four direction ejection of the stacks. However, because most articles to be stacked are rectangular in the case of four direction ejection, it is necessary to rotate the turntable between stacking operations and ejection operations reducing the overall output speed.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is claimed:

1. A stacking apparatus comprising:

an infeed assembly receiving a stream of papers traveling in an infeed direction;

a plurality of movable forks receiving the stream of papers in a plurality of batches;

a turntable assembly for receiving said batches to form stacks, the turntable assembly including a rotatable turntable and a discharge element for ejecting the stacks in two opposite stack discharge directions;

a motor for rotating the turntable assembly 180° between successive batches; and positioning means for positioning the turntable assembly in a first position in which the two opposite stack discharge directions are at a first angle with respect to the infeed direction and in a second position in which the two opposite stack discharge directions are at a second angle with respect to the infeed direction.

2. The stacking apparatus of claim 1, wherein in the first position the two opposite stack discharge directions are parallel to the infeed direction.

3. The stacking apparatus of claim 2, wherein in the second position the two opposite stack discharge directions are normal to the infeed direction.

4. The stacking assembly of claim 1, wherein the infeed assembly includes an upper belt and a lower belt, and wherein the upper belt is spring loaded to accommodate varying thicknesses of papers.

5. The stacking assembly of claim 4, wherein the lower belt is normally fixed during a stacking operation.

6. The stacking assembly of claim 1, wherein the turntable assembly includes pivotable end gates having an open position which allow the stack to be discharged and a closed position in which the gates act as guides to support the stack.

7. The stacking assembly of claim 6, wherein the end gates are held in the closed position by pneumatic cylinders.

8. The stacking apparatus of claim 1, wherein a difference between the first and second angle is 90°.

9. The stacking apparatus of claim 1, wherein the positioning means includes a bearing allowing the turntable assembly and the motor to rotate and a locking mechanism for locking the turntable assembly in the first position and the second position.

10. The stacking assembly of claim 1, wherein the turntable assembly is mounted on a base plate which is pivotable with respect to a base frame by disengaging a locking mechanism.

11. The stacking assembly of claim 1, wherein the discharge element comprises first and second chains each supporting at least one post, the first chain extending in a first loop which passes around approximately one half of the turntable and down approximately a center of the turntable, the second chain extending in a second loop which passes around approximately an opposite half of the turntable from the first loop and down approximately a center of the turntable, wherein one post on each of the first and second chains operate together to discharge a stack.

12. The stacking assembly of claim 1, wherein the discharge element includes a chain having a lower surface and an upper surface substantially coplanar with a top surface of the turntable and at least one post attached to the chain and extending substantially perpendicular to the turntable top surface, and wherein none of the posts extend below a lower surface of the chain.

13. The stacking assembly of claim 1, wherein the turntable assembly includes shock absorbers which stop the motion of the turntable provided by the motor.

14. A turntable assembly for a stacking device comprising:

a rotatable turntable platform having two substantially semicircular tracks formed at a top surface of the platform, the tracks extending in parallel paths along a center portion of the turntable platform;

an ejection assembly for ejecting stacks from the turntable platform including two chains received in the two tracks and at least one post extending from each of the chains, the chains having an upper surface that is substantially even with the top surface of the platform and a lower surface that extends into the top surface; and a motor driving the two chains to eject the stacks.

15. The turntable assembly of claim 14, further comprising four guide members mounted on the turntable assembly along each of four sides of the turntable assembly for abutting four edges of the stack to create an even stack, wherein two of the four guide members are movable gates.

16. The turntable assembly of claim 15, wherein the posts engage the stack at a center portion of the stack between two of the four edges.

17. The turntable assembly of claim 14, wherein the posts are each attached to one of the chains and terminate above a lower surface of the chains.

18. The stacking device of claim 14 wherein the motor moves the posts together along the parallel paths without imparting a rotational moment to the stacks.

19. A turntable assembly for a stacking device comprising:

a rotatable turntable platform for stacking articles;

an ejection assembly for ejecting stacks of articles from the turntable platform;

two side guide members extending vertically from the turntable platform and adjustable to vary a first dimension of the stack between the two side guide members;

two end guide members mounted on each of the side guide members for abutting ends of the stacks, the end guide members being adjustable to vary a second dimension of the stack; and a pneumatic device holding the end guide members in a closed position.

20. The turntable assembly of claim 19, wherein the pneumatic device includes a control device which activated a pneumatic cylinder to move the end guide members to a closed position, and deactivates the pneumatic cylinder to allow the end guide members to move to an open position in which the stack is pushed off of the turntable platform.

21. A stacking device for stacking articles and discharging stacks of articles, the stacking device comprising:

an article receiving portion for receiving a stream of articles traveling in an infeed direction;

a stacking portion for stacking the articles received in the article receiving portion on a turntable to form stacks;

an assembly for discharging the stacks in first opposite discharge directions which are parallel to the infeed direction when the turntable is oriented in a first orientations; and, a positioning assembly that orients the turntable platform in a second position to discharge the stacks in second opposite directions which are normal to the infeed direction when the turntable is oriented in a second orientation.

22. The stacking device of claim 21 wherein the discharging assembly includes first and second posts for simultaneously ejecting the stacks from the turntable.

23. The stacking device of claim 22 wherein the first and second posts are driven by chains in opposite rotational directions on the turntable to prevent a moment from being imposed on the stacks.

24. The stacking device of claim 22 wherein the first and second posts are positioned on the turntable to engage the stacks at a central location.

25. A stacking device of claim 21, wherein the stacking portion includes the turntable and a motor for rotating the turntable 180° during stacking, the turntable and motor mounted on a rotatable platform for adjusting an orientation of the turntable to the first orientation and the second orientation.

* * * * *